US011883878B2

(12) United States Patent
Papadimitriou et al.

(10) Patent No.: US 11,883,878 B2
(45) Date of Patent: Jan. 30, 2024

(54) DIECASTING TOOL

(71) Applicant: GF Casting Solutions AG, Schaffhausen (CH)

(72) Inventors: Ilias Papadimitriou, Buettenhardt (CH); Fabian Kohlbrenner, Hoechenschwand (DE); Stephan Philipp, Gailingen (DE); Michael Just, Schaffhausen (CH); Alexander Weissensteiner, St. Gallen (AT)

(73) Assignee: GF CASTING SOLUTIONS AG, Schaffhausen (CH)

( * ) Notice: Subject to any disclaimer, the term of this patent is extended or adjusted under 35 U.S.C. 154(b) by 0 days.

(21) Appl. No.: 17/947,180

(22) Filed: Sep. 19, 2022

(65) Prior Publication Data

US 2023/0092300 A1 Mar. 23, 2023

(30) Foreign Application Priority Data

Sep. 21, 2021 (EP) ..... 21197908

(51) Int. Cl.
*B22D 17/24* (2006.01)
*B22D 17/00* (2006.01)
*B22D 17/22* (2006.01)

(52) U.S. Cl.
CPC ..... *B22D 17/24* (2013.01); *B22D 17/002* (2013.01); *B22D 17/2209* (2013.01)

(58) Field of Classification Search
CPC ..... B22D 17/00; B22D 17/002; B22D 17/22; B22D 17/24; B22D 19/00; B22D 19/0009; B22D 19/0054; B22D 19/0072
See application file for complete search history.

(56) References Cited

U.S. PATENT DOCUMENTS

| | | | | |
|---|---|---|---|---|
| 2003/0056358 | A1 | 3/2003 | Pflueger | |
| 2007/0065064 | A1* | 3/2007 | Kitamura | F16C 19/54 384/537 |
| 2016/0256921 | A1 | 9/2016 | Maki et al. | |

FOREIGN PATENT DOCUMENTS

| | | | |
|---|---|---|---|
| CA | 999166 | A | 11/1976 |
| DE | 199 43 247 | C1 | 1/2001 |
| DE | 100 54 330 | A1 | 5/2002 |
| DE | 102010051356 | A1 | 5/2012 |
| JP | H08-312447 | A | 11/1996 |
| KR | 101365196 | B1 | 2/2014 |

* cited by examiner

*Primary Examiner* — Kevin P Kerns
*Assistant Examiner* — Steven S Ha
(74) *Attorney, Agent, or Firm* — LEYDIG, VOIT & MAYER, LTD.

(57) ABSTRACT

A diecasting tool has an insert for producing a cooled motor housing. The diecasting tool has mould halves including: a stationary mould half; and movable mould half. One of the mould halves has a cylindrically extending annular gap having a central axis. The moveable mould half is arranged so as to be movable parallel to the central axis. The insert is arranged in the cylindrically extending annular gap. The insert is a bush. One end of the bush projects into a mould cavity, which is formed by the stationary mould half and the movable mould half, and is at least partially surrounded in a form-fitting manner by the casting material in a state when the casting material is cast.

20 Claims, 4 Drawing Sheets

DIECASTING TOOL

CROSS-REFERENCE TO PRIOR APPLICATIONS

This application claims benefit to European Patent Application No. EP 21 197 908.3, filed on Sep. 21, 2021, which is hereby incorporated by reference herein.

FIELD

The present disclosure relates to a diecasting tool.

BACKGROUND

Cooled motor housings have an outer lateral surface as well as an inner lateral surface, between which an encircling gap is formed, which serves for cooling or in which the cooling medium circulates.

Diecastig tools can have parts inserted for encapsulation.

DE 199 43 247 C1 discloses a diecasting mould in which an insert is partially encapsulated. The insert is a compact, workpiece of solid design which is inserted into the mould and positioned in the mould by means of a presser.

DE 100 54 330 discloses a method for producing a composite casting which is designed as an end shield.

The disadvantage of the prior art is that only solid parts can be cast in, and there is no knowledge of producing a cooled motor housing by diecasting, or there are no diecasting tools which enable thin-walled, concentrically extending walls to be produced without using a further process step after casting.

SUMMARY

In an embodiment, the present invention provides a diecasting tool that has an insert for producing a cooled motor housing. The diecasting tool has mould halves including: a stationary mould half; and movable mould half. One of the mould halves has a cylindrically extending annular gap having a central axis. The moveable mould half is arranged so as to be movable parallel to the central axis. The insert is arranged in the cylindrically extending annular gap. The insert is a bush. One end of the bush projects into a mould cavity, which is formed by the stationary mould half and the movable mould half, and is at least partially surrounded in a form-fitting manner by the casting material in a state when the casting material is cast.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following:

FIG. 2 shows a detail view of the thickened wall portion of the bush cast in;

FIG. 5 shows a detail view of the bush with a partial base cast in; and

DETAILED DESCRIPTION

Figure 1:
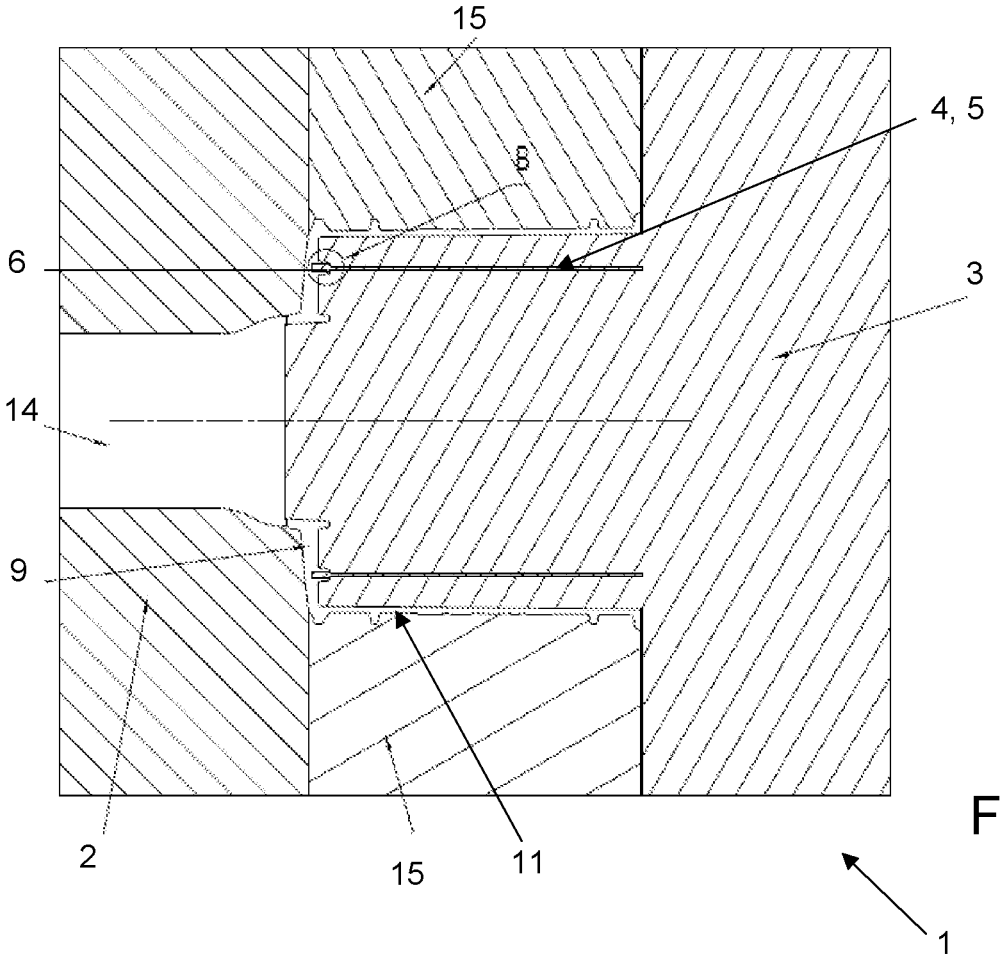
FIG. 1 shows a longitudinal sectional view of a diecasting tool according to the invention having a bush with a thickened wall portion.

Aspects of the present disclosure relate to a diecasting tool having an insert for producing a cooled motor housing, preferably an electric motor housing, and to the production method for a cooled motor housing, and to the use of the diecasting tool to produce a cooled motor housing, comprising at least one stationary mould half and at least one movable mould half, wherein one of the two mould halves has a cylindrically extending annular gap having a central axis, wherein the movably arranged mould half is arranged so as to be movable parallel to the central axis.

Aspects of the present disclosure provide a diecasting tool and its application for the production of a cooled motor housing, as well as a production method in which no further method steps are required for the installation of an inner wall in a cooled motor housing, or a cooled motor housing can be produced in one method step.

Aspects of the present disclosure take advantage of having an insert arranged in the cylindrically extending annular gap, wherein the insert is designed as a thin-walled bush, and wherein one end of the bush projects into a mould cavity, which is formed by the stationary and the movable mould halves, and is at least partially surrounded in a form-fitting manner by the casting material when the casting material is cast. The bush preferably extends over the entire length of the annular gap.

The diecasting tool according to an aspect of the present disclosure for producing a cooled motor housing, preferably an electric motor housing, comprises at least one stationary mould half and at least one movable mould half.

A cooled motor housing has an inner and an outer lateral surface, between which an encircling gap is formed in which the cooling medium circulates. With the aid of the diecasting tool according to an aspect of the present disclosure, the production of such a housing with two thin-walled, concentrically arranged, cylindrical walls is made possible.

One of the two mould halves has a cylindrically extending annular gap having a central axis, wherein the movably arranged mould half is arranged so as to be movable parallel to the central axis. An insert is arranged in the cylindrically extending annular gap, wherein the insert is designed as a bush. The bush is of thin-walled design and serves to form the inner lateral surface of a cooled motor housing. One end of the bush projects into the mould cavity, which is formed by the stationary and the movable mould halves, and is at least partially surrounded in a form-fitting manner by the casting material when the casting material is cast.

The bush preferably has a chamfer running around the outer diameter. The chamfer of the bush rests against a chamfer in one of the mould halves, as a result of which the cylindrically extending annular gap is sealed. A situation where casting material flows into the annular gap and is arranged on the lateral surface of the bush is thereby avoided.

The bush has a thickened portion of the wall at least at one end, wherein the thickened portion preferably forms at least one partially encircling collar. That is to say that the bush has an increase in wall thickness over a certain length at at least one end. The thickened portion of the wall need not extend over the entire circumference but, in a preferred embodiment, the thickened wall portion extends over the entire circumference. The thickened wall portion projects into the mould cavity arranged at the end, wherein the mould cavity is formed by the stationary and the movable mould halves, and the thickened wall portion is at least partially surrounded in a form-fitting manner by the casting material when the casting material is cast. The mould cavity arranged at the end with the thickened wall portion of the bush projecting into it forms the mould cavity for the one end of the motor housing, which is then formed at least as a partially closed end by the inflowing casting material. Alternatively, the bush has a partial base at at least one end, wherein the partial base projects into the mould cavity. Here, too, the mould cavity, which is arranged at the end, with the inwardly projecting partial base of the bush then forms one end of the motor housing.

It has been found to be advantageous if the one-piece, thin-walled bush is formed from a thickened wall portion arranged at one end or from a partial base and a lateral surface, wherein a chamfer is arranged in the transition between the thickened portion and the lateral surface or between the partial base and the lateral surface, wherein the chamfer serves to seal the cylindrically extending annular gap.

The preferably metallic, thin-walled bush serves to form the inner lateral surface of the motor housing and is connected in a form-fitting manner to the remaining part of the motor housing or is encapsulated therein by the at least partial encapsulation of the thickened wall portion or of the partial base, as a result of which the motor housing is of one-piece design while containing two different materials. On the one hand, a casting material, preferably a light metal alloy, such as an aluminium or magnesium alloy, and a pressed material, preferably consisting of a light metal alloy, such as an aluminium or magnesium alloy. It has proven to be particularly preferred if the materials of the casting and pressed material have the same material basis, that is to say if the casting and pressed material are each produced from an aluminium alloy or magnesium alloy. The chamfer ensures that no casting material runs into the annular gap or no casting material adheres to the lateral surface of the insert or of the bush.

According to a preferred embodiment, the cylindrically extending annular gap has an encircling chamfer at the open end in the mould half. The annular gap is preferably arranged in the movable mould half, facilitating the insertion of the bush. In addition to the sealing function, the chamfer also permits optimum centring of the bush, which has the corresponding chamfer.

It is advantageous if the encircling chamfer on the annular gap corresponds to the chamfer on the bush, and as a result the annular gap is tightly closed and no casting material flows into the annular gap. As a result of the sealing, a sufficiently large tolerance can be provided between the bush or the wall thickness of the lateral surface and the annular gap width, and, on the one hand, this facilitates insertion and, on the other hand, during casting, allows a certain distortion of the bush, while the bush nevertheless remains removable from the mould. Moreover, optimum sealing by means of obliquely arranged surfaces or chamfers permits optimum centring of the bush in the annular gap.

For the purpose of forming the housing lateral surface, it has proven advantageous for the diecasting tool according to an aspect of the present disclosure to have a mould cavity which is arranged so as to be offset concentrically outwards with respect to the annular gap. To form the housing lateral surface, this mould cavity is preferably formed with the aid of slides and at least one mould half. This makes it possible to apply a rib pattern or screw-on lugs or other reinforcements to the housing in accordance with requirements.

The mould cavity for forming the housing lateral surface, the cylindrical annular gap and the bush arranged therein preferably extend over the same length. That is to say that the inner and outer lateral surfaces of the cooled motor housing have the same length or end flush or at the same level at the opposite end of the thickened wall portion or of the partial base.

It has also been found to be a preferred embodiment if the diecasting tool has a plurality of slides. This makes it possible to apply a rib pattern or screw-on lugs or other reinforcements to the housing in accordance with requirements.

It has been found to be a preferred embodiment if the bush has at least two encircling chamfers, wherein the chamfers are aligned mirror-image fashion and correspond to the chamfers in the diecasting tool or rest in a sealing manner against the diecasting tool. As a result of the mirror-image alignment or the slope of the chamfers in the different directions, the bush is optimally centered and sealed at at least two points.

The bush with a partial base preferably has ribs on the underside of the partial base for stiffening the latter. In addition, the ribs transmit the torque produced by the electric motor to the cast outer lateral surface of the housing. It is advantageous if the ribs are aligned radially outwards at regular intervals from the center.

Advantages of embodiments implemented according to aspects of the present disclosure are achieved by the fact that the annular gap is sealed by a chamfer on the insert and by a corresponding chamfer on the annular gap and remains free of casting material.

The method according to an aspect of the present disclosure for producing a cooled motor housing, preferably an electric motor housing, from a light metal composite casting material, comprises the following steps:

- providing a diecasting mould, preferably comprising at least two mould halves, having a bush which is inserted in an annular gap in a mould half of the diecasting tool, wherein one mould half is arranged movably,
- closing the diecasting tool, preferably by moving one mould half parallel to the central axis X of the annular gap,
- filling the diecasting tool with a light metal alloy, wherein the thickened wall portion or the partial base of the bush is at least partially surrounded in a form-fitting manner by the casting material. In this case, the annular gap is sealed by means of a chamfer on the bush and a corresponding chamfer on the annular gap and remains free of casting material.

It is advantageous if the bush is inserted into the annular gap in one mould half in such a way that the thickened wall portion arranged at one end of the bush or the partial base projects into a mould cavity which forms one side of the motor housing or the shape of the end of the motor housing which is filled with casting material and which forms one end of the motor housing.

The casting material preferably flows via a gate provided for this purpose into the diecasting mould, the gate adjoining the end of the motor housing, which is at least partially closed.

It is advantageous if the bush is inserted into the movably arranged mould half. This facilitates accessibility and insertion of the bush.

Advantages of embodiments implemented according to aspects of the present disclosure are achieved by the fact that the cooled motor housing has an inner lateral surface, wherein the inner lateral surface is formed by a cast-in insert, wherein the insert is designed as a thin-walled hollow cylinder.

The use according to an aspect of the present disclosure of the diecasting mould serves for the production of a cooled motor housing, wherein the cooled motor housing has an inner lateral surface, wherein the inner lateral surface is formed by a cast-in bush, wherein the bush is of thin-walled design.

A cooled motor housing according to an aspect of the present disclosure has an inner and an outer lateral surface, between which an encircling gap is formed in which the cooling medium circulates. The motor housing according to an aspect of the present disclosure has two thin-walled, concentrically arranged, cylindrical walls which each form the inner and outer lateral surface of the housing.

It is advantageous if the motor housing bush which serves to form the inner lateral surface consists of a metallic material, preferably aluminium or magnesium or an aluminium or magnesium sheet corresponding to the casting alloy used, as already mentioned above. The outer lateral surface is formed by the casting material and is preferably made of a light metal alloy, preferably an aluminium or magnesium alloy.

The cooled motor housing according to an aspect of the present disclosure is preferably designed as a light metal composite casting. Thus, in addition to the light metal casting material, it also consists of a further metallic material, preferably a light metal, which has already been inserted into the diecasting tool and is surrounded by the light metal casting material in such a way that the cooled motor housing is formed as a one-piece light metal composite casting.

Furthermore, it is advantageous if the inner and outer lateral surfaces extend over the same length.

All design options can be freely combined with one another, both the features of the diecasting tool, the method and its use for producing the cooled motor housing.

An exemplary embodiment of the present disclosure is described with reference to the figures, wherein the present disclosure is not limited to the exemplary embodiment.

Figure 4:
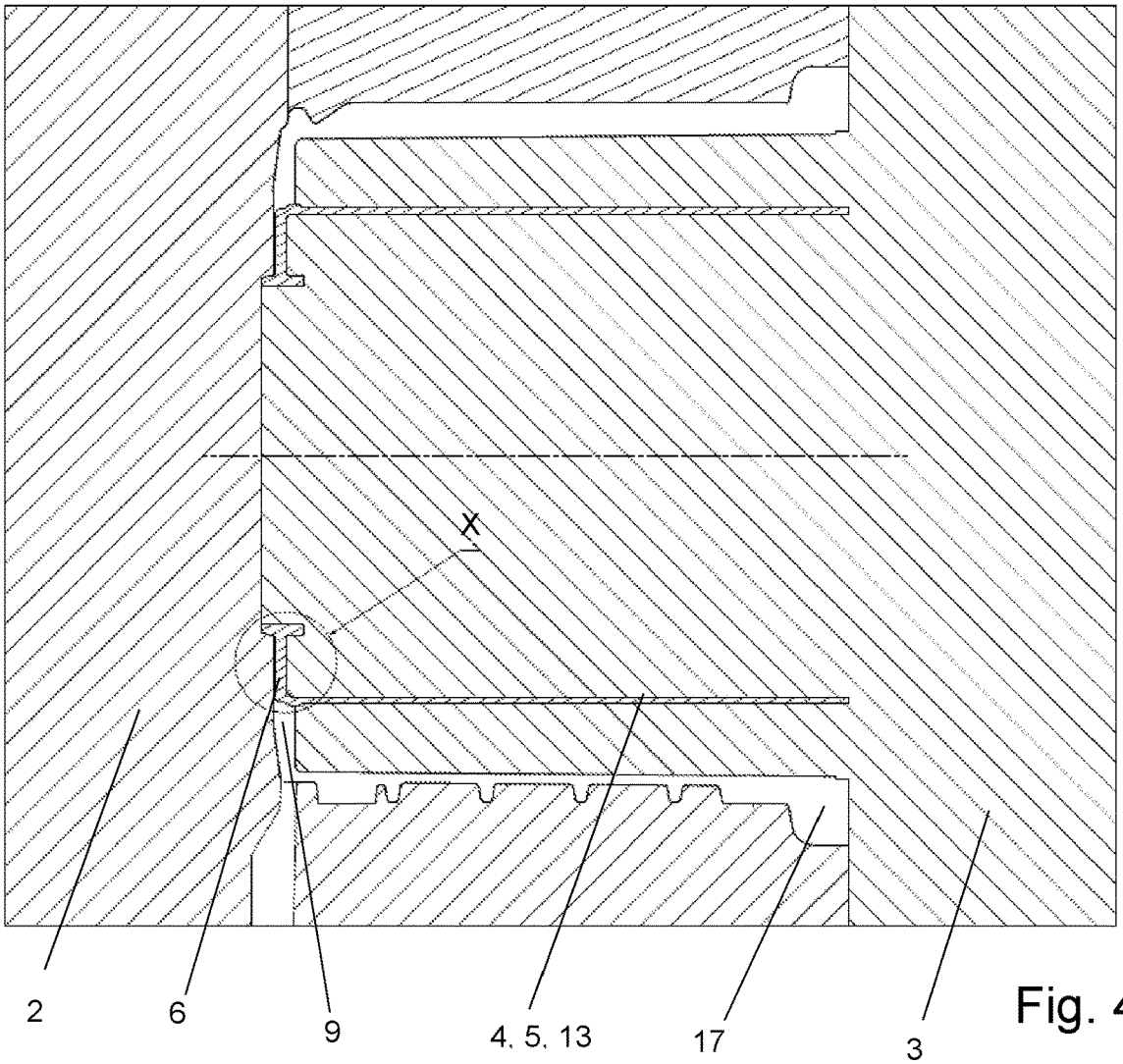
FIG. 4 shows a longitudinal sectional view of a diecasting tool according to the invention having a bush with a partial base.

The drawings illustrated in FIGS. 1 and 4 show a diecasting tool 1 in a sectional view. The diecasting tool 1 serves to produce a cooled motor housing 12, wherein a cooled motor housing has an inner 13 and an outer wall 17, between which the cooling medium circulates. The diecasting tool 1 comprises at least one stationary and at least one movable or displaceable mould half 2, 3. In one of the two mould halves 2, 3, a cylindrically extending annular gap 4 is arranged with a central axis X. The movable mould half 3 is arranged so as to be movable parallel to the central axis X. An insert 5, which is designed as a bush, is arranged in the annular gap 4 and preferably extends over the entire length of the annular gap 4. The bush 5 has at one end a thickened wall portion 6, as shown in FIG. 1, or a partial base 6, as shown in FIG. 4. The thickened wall portion 6 or the partial base 6 projects into the mould cavity 9. The mould cavity 9, which is arranged at the end, forms the cavity for the formation of the end of the motor housing 12, into which the thickened wall portion 6 or the partial base 6 of the bush projects and is thereby at least partially surrounded in a form-fitting manner by the casting material.

The thickened wall portion 6 of the wall of the bush preferably extends continuously along the entire circumference.

Figure 2:
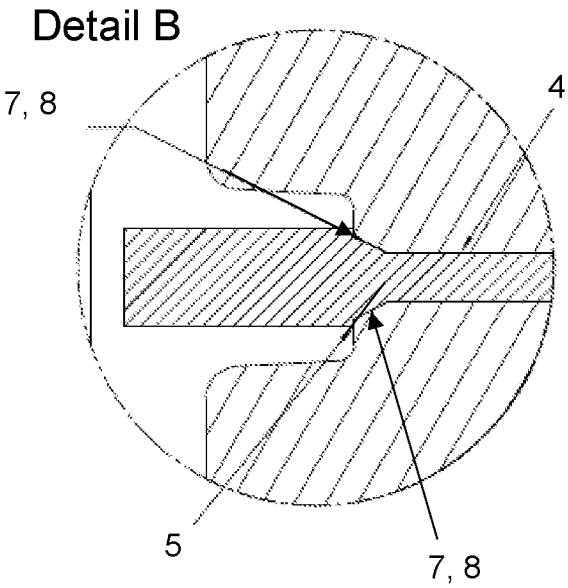

From the detail view in FIG. 2, it can be clearly seen that a chamfer 7 is arranged in the transitional region of the bush 5 between the thickened wall portion 6 and the lateral surface 10 of the bush 5. This serves, on the one hand, for sealing as well as for centring. Similarly, the mould half 3 or the annular gap 4 has a chamfer 8 at the open end, which chamfer corresponds to the chamfer 7 on the bush and thereby seals the annular gap 4 in such a way that no casting material flows into the annular gap 4 and adheres to the lateral surface 10 of the bush 5. In addition, the encircling chamfers 7, 8 form a cone which serves to center the bush 5. The bush 5 and the annular gap 4 preferably have chamfers aligned mirror-image fashion. In this embodiment, the two chamfers are arranged on both sides and there is a chamfer 7, 8 directed inwards and outwards.

The mould cavity 11 arranged in the diecasting tool 1 and extending concentrically with the annular gap 4 forms the mould for the outer housing lateral surface or the outer wall 17 of the motor housing. To enable the cooled motor housing 12 to be removed from the mould, the diecasting tool 1 preferably has slides 15. The gate 14 of the diecasting tool 1 is preferably arranged on the side of the mould cavity 9 which forms the end of the partially closed motor housing 12.

Figure 3:
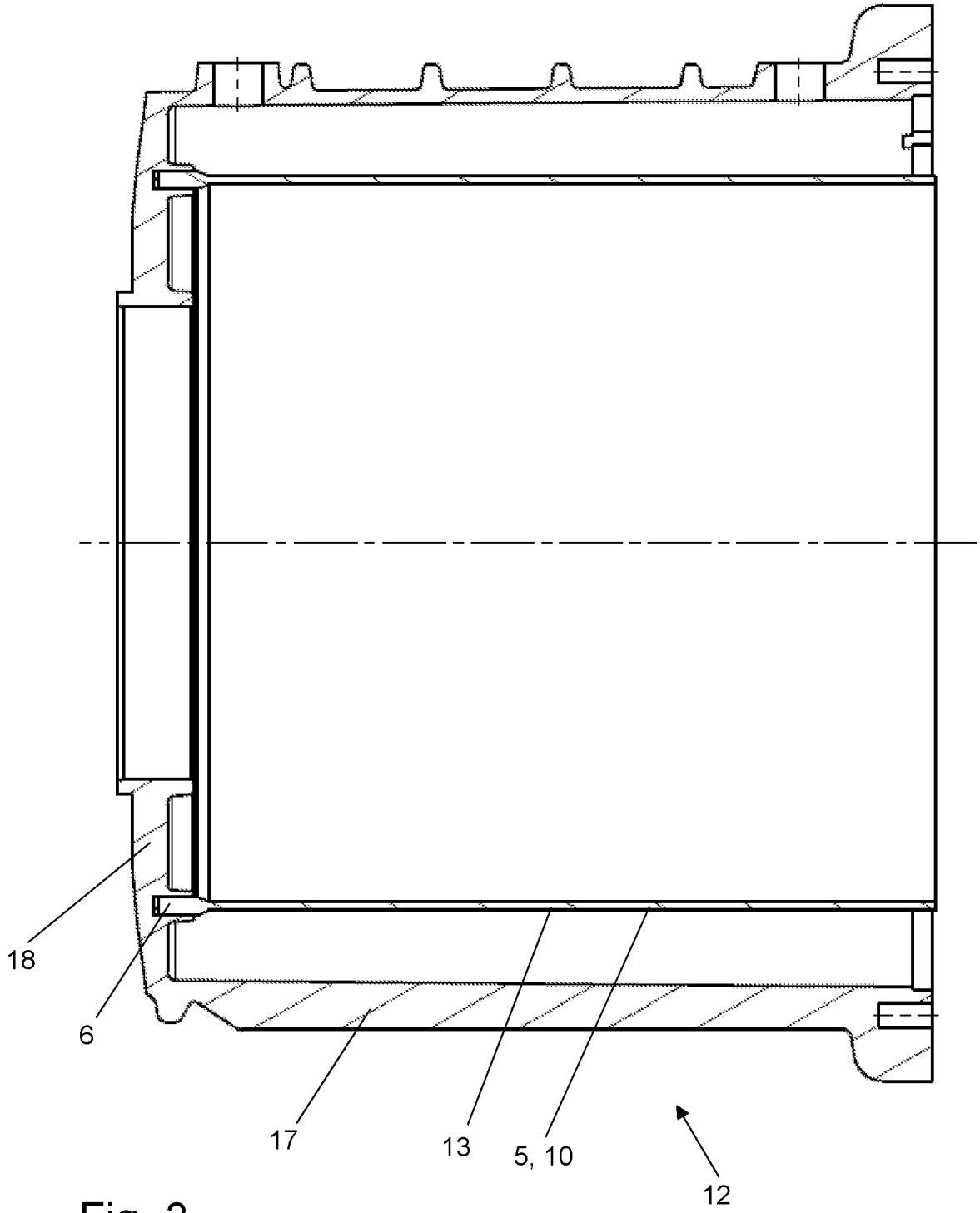
FIG. 3 shows a longitudinal section through a cooled motor housing according to the invention having a bush with a thickened wall portion.

FIG. 3 shows the finished cooled motor housing 12 with a bush 5 which has a thickened wall portion 6 for the form-fitting connection to the casting material. The bush 5 forms the inner lateral surface 13 of the motor housing 12 and the outer wall is formed by the casting material.

FIG. 4 shows a sectional view through a diecasting tool 1 with an inserted bush 5, wherein the bush 5 has a partial base 6 at one end. This projects into the cavity 9, which is formed by the two mould halves 2, 3. The chamfer 7, which is arranged on the outer circumference of the bush 5, corresponds to the chamfer 8 on the mould half and thus seals the annular gap 4. This prevents casting material from flowing into the annular gap 4, which prevents casting material from adhering to the lateral surface 10 of the bush 5.

Figure 5:
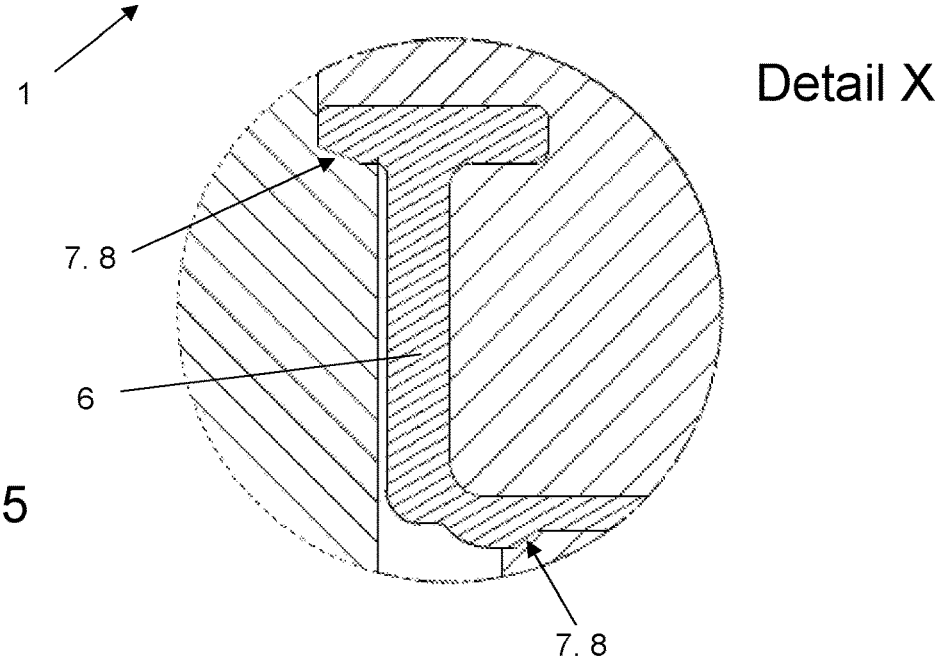

FIG. 5 shows a detail of the bush 5 with a partial base. It can be clearly seen here that the bush 5 has two encircling chamfers 7. One is arranged near the lateral surface 10 and the other is arranged in the end region of the partial base 6. The chamfers 7 run mirror-image fashion relative to the corresponding chamfers 8 in the diecasting tool 1.

Figure 6:
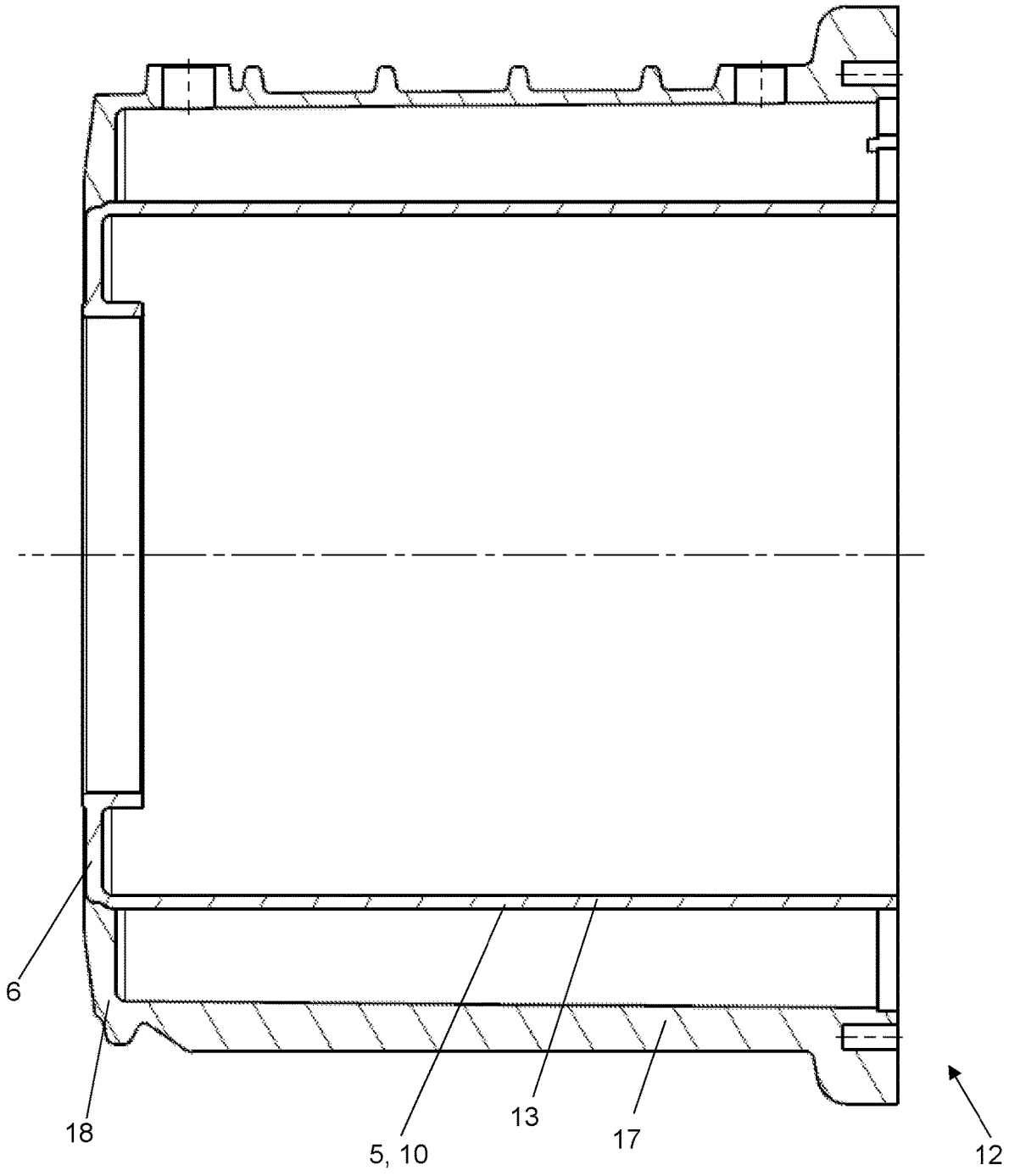
FIG. 6 shows a longitudinal section through a cooled motor housing according to the invention having a bush with a partial base.

FIG. 6 clearly shows that the end of the motor housing 12 is partly formed by the partial base 6 of the bush and the other part is formed by casting material.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 Diecasting tool
2 Mould half
3 Mould half, movable, displaceable
4 Annular gap
5 Bush
6 Thickened wall portion/partial base
7 Chamfer on bush
8 Chamfer on annular gap
9 Mould cavity
10 Lateral surface of bush
11 Mould cavity for outer housing lateral surface
12 Cooled motor housing
13 Inner lateral surface/inner wall
14 Gate
15 Slide
16 Ribs
17 Outer wall/housing lateral surface
18 End of motor housing

The invention claimed is:

1. A diecasting tool having an insert for producing a cooled motor housing, the diecasting tool comprising mould halves comprising:
- a stationary mould half; and
- a movable mould half,
- wherein one of the mould halves has a cylindrically extending annular gap having a central axis,
- wherein the moveable mould half is arranged so as to be movable parallel to the central axis,
- wherein the insert is arranged in the cylindrically extending annular gap,
- wherein the insert is a bush,
- wherein one end of the bush projects into a mould cavity, which is formed by the stationary mould half and the movable mould half, and is at least partially surrounded in a form-fitting manner by a casting material in a state when the casting material is cast, and
- wherein the bush has at least one chamfer running around an outer diameter, wherein the at least one chamfer of the bush rests in a seating manner against at least one chamfer of the mould halves and the at least one chamfer of the bush seals the cylindrically extending angular gap.

2. The diecasting tool according to claim 1, wherein the bush has a thickened wall portion or a partial base at one end, wherein the thickened wall portion or the partial base projects into the mould cavity.

3. The diecasting tool according to claim 1, wherein the bush has a lateral surface, wherein the at least one chamfer of the bush is arranged in a transitional region between a thickened wall portion and the lateral surface or a partial base and the lateral surface.

4. The diecasting tool according to claim 1, wherein the cylindrically extending annular gap has an encircling chamfer at an open end in the mould halves.

5. The diecasting tool according to claim 1, wherein an encircling chamfer on the annular gap corresponds to the at least one chamfer of the bush, and as a result the annular gap is closed and no casting material flows into the annular gap.

6. The diecasting tool according to claim 1, wherein, in order to form a housing lateral surface, the diecasting tool has a further mould cavity which is arranged so as to be offset concentrically outwards with respect to the annular gap.

7. The diecasting tool according to claim 6, wherein the further mould cavity for forming the housing lateral surface, the cylindrical annular gap and the bush arranged therein extend over the same length.

8. The diecasting tool according to claim 1, wherein the diecasting tool has a plurality of slides.

9. The diecasting tool according to claim 1, wherein the at least one chamfer of the bush includes at least two encircling chamfers and the at least one chamfer of the mould halves includes at least two chamfers, wherein the at least two encircling chamfers are aligned in mirror-image fashion and correspond to the at least two chamfers of the mould halves or rest in a sealing manner against the diecasting tool.

10. A diecasting tool having an insert for producing a cooled motor housing, the diecasting tool comprising mould halves comprising:
- a stationary mould half; and
- a movable mould half,
- wherein one of the mould halves has a cylindrically extending annular gap having a central axis,
- wherein the moveable mould half is arranged so as to be movable parallel to the central axis,
- wherein the insert is arranged in the cylindrically extending annular gap,
- wherein the insert is a bush,
- wherein one end of the bush projects into a mould cavity, which is formed by the stationary mould half and the movable mould half, and is at least partially surrounded in a form-fitting manner by a casting material in a state when the casting material is cast, and
- wherein the cylindrically extending annular gap has an encircling chamfer at an open end in the mould halves.

11. The diecasting tool according to claim 10, wherein the bush has at least one chamfer running around an outer diameter, wherein the at least one chamfer of the bush rests in a sealing manner against at least one chamfer of the mould halves, the at least one chamfer of the mould halves including the encircling chamfer of the annular gap, and the at least one chamfer of the bush seals the cylindrically extending annular gap.

12. The diecasting tool according to claim 10, wherein the bush has a thickened wall portion or a partial base at one end, wherein the thickened wall portion or the partial base projects into the mould cavity.

13. The diecasting tool according to claim 11, wherein the bush has a lateral surface, wherein the at least one chamfer of the bush is arranged in a transitional region between a thickened wall portion and the lateral surface or a partial base and the lateral surface.

14. The diecasting tool according to claim 10, wherein an encircling chamfer on the annular gap corresponds to at least one chamfer of the bush, and as a result the annular gap is closed and no casting material flows into the annular gap.

15. The diecasting tool according to claim 10, wherein, in order to form a housing lateral surface, the diecasting tool has a further mould cavity which is arranged so as to be offset concentrically outwards with respect to the annular gap.

16. The diecasting tool according to claim 15, wherein the further mould cavity, for forming the housing lateral surface, the cylindrical annular gap and the bush arranged therein extend over the same length.

17. The diecasting tool according to claim 10, wherein the diecasting tool has a plurality of slides.

18. The diecasting tool according to claim 1, wherein the at least one chamfer of the bush includes at least two encircling chamfers and the at least one chamfer of the mould halves includes at least two chamfers, wherein the at least two encircling chamfers are aligned in mirror-image fashion and correspond to the at least two chamfers of the mould halves or rest in a sealing manner against the diecasting tool.

19. A diecasting tool having an insert for producing a cooled motor housing, the diecasting tool comprising mould halves comprising:

a stationary mould half; and a movable mould half, wherein one of the mould halves has a cylindrically extending annular gap having a central axis, wherein the moveable mould half is arranged so as to be movable parallel to the central axis, wherein the insert is arranged in the cylindrically extending annular gap, wherein the insert is a bush, wherein one end of the bush projects into a mould cavity, which is formed by the stationary mould half and the movable mould half, and is at least partially surrounded in a form-fitting manner by a casting material in a state when the casting material is cast, and wherein an encircling chamfer on the annular gap corresponds to at least one chamfer of the bush, and as a result the annular gap is closed and no casting material flows into the annular gap.

20. The diecasting tool according to claim 19, wherein the at least one chamfer of the bush runs around an outer diameter, wherein the at least one chamfer of the bush rests in a sealing manner against a chamfer of the mould halves, and the at least one chamfer of the bush seals the cylindrically extending annular gap.

* * * * *